US011054229B2

(12) United States Patent
Benade et al.

(10) Patent No.: US 11,054,229 B2
(45) Date of Patent: Jul. 6, 2021

(54) DEVICE FOR VENTING AN EXPLOSIVE CHARGE AND MUNITION EQUIPPED WITH SUCH A DEVICE

(71) Applicant: THALES, Courbevoie (FR)

(72) Inventors: Eroan Benade, La Ferté Saint Aubin (FR); Jean-Sébastien Schwartz, La Ferté Saint Aubin (FR); Romain Baillargeat, La Ferté Saint Aubin (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/703,787

(22) Filed: Dec. 4, 2019

(65) Prior Publication Data

US 2020/0191538 A1 Jun. 18, 2020

(30) Foreign Application Priority Data

Dec. 13, 2018 (FR) ..... 1872833

(51) Int. Cl.
*F42B 39/20* (2006.01)
*F42B 12/20* (2006.01)

(52) U.S. Cl.
CPC ..... *F42B 12/207* (2013.01); *F42B 39/20* (2013.01)

(58) Field of Classification Search
CPC ..... F42B 39/00; F42B 39/20; F42B 39/14; F42B 12/207
USPC ..... 102/202.1
See application file for complete search history.

(56) References Cited

U.S. PATENT DOCUMENTS

| | | | | | |
|---|---|---|---|---|---|
| 5,035,181 | A * | 7/1991 | Jacks | F42B 39/20 | 102/293 |
| 6,035,631 | A * | 3/2000 | Cannon | F02K 9/343 | 220/89.2 |
| 10,378,870 | B1 * | 8/2019 | Wu | F42C 19/04 | |
| 2010/0024675 | A1 * | 2/2010 | Cotet | F42B 39/20 | 102/481 |
| 2010/0089272 | A1 * | 4/2010 | Cook | F42B 39/14 | 102/481 |
| 2017/0016705 | A1 * | 1/2017 | Jung | F42B 39/20 | |

FOREIGN PATENT DOCUMENTS

| | | | | |
|---|---|---|---|---|
| EP | 2 275 774 | A1 | 1/2011 | |
| EP | 2 461 129 | A1 | 6/2012 | |
| EP | 2703769 | A1 * | 3/2014 | F42B 39/20 |
| EP | 2 933 598 | A2 | 10/2015 | |
| FR | 2 906 606 | A1 | 4/2008 | |
| FR | 2 922 638 | A1 | 4/2009 | |

* cited by examiner

*Primary Examiner* — Stephen Johnson
(74) *Attorney, Agent, or Firm* — BakerHostetler

(57) ABSTRACT

A venting device for a projectile includes a first part comprising a body containing an explosive charge and a second part comprising an actuating element for triggering the explosive charge, the first and second parts forming an assembly able to confine the explosive charge when they are connected, the venting device comprising: a sealing means configured to render the projectile gastight and fluidtight when the first and second parts are connected; an opening means able to allow the projectile to open, the opening means being able to be triggered when the internal pressure in the projectile is higher than or equal to a given pressure threshold; a pushing means able to enlarge the opening of the projectile once the opening means has been triggered.

15 Claims, 5 Drawing Sheets

DEVICE FOR VENTING AN EXPLOSIVE CHARGE AND MUNITION EQUIPPED WITH SUCH A DEVICE

CROSS-REFERENCE TO RELATED APPLICATIONS

This application claims priority to foreign French patent application No. FR 1872833, filed on Dec. 13, 2018, the disclosure of which is incorporated by reference in its entirety.

FIELD OF THE INVENTION

The present invention relates to a device for venting an explosive charge.

It also relates to a munition equipped with such a device.

It applies notably to reducing the sensitivity of munitions by venting the explosive charge.

BACKGROUND

When munitions are being transported, stored or used (for example on ships, in depots, in the field of operation), there is a risk that the munitions will be exposed to attack, typically thermal attack, which may cause the explosive charge to explode in an undesired manner. Such impromptu explosions may cause accidents and have significant human and materiel consequences. These accidents may assume enormous proportions if, in a nearby environment, there are other weapons which may in their turn react violently, going so far as to cause nominal detonation of their own explosive charges.

In order to avoid this risk, it is necessary to have safer reduced-sensitivity munitions that react in the nominal way only on demand, or at the very least which react only moderately to external attack, which means to say at the very least, which react without leading to loss of human life and materiel.

In order to quantify the risk in a way that is as universal as possible, the relevant authorities worldwide have devised a frame of reference that allows different weapons to be classified according to their level of insensitivity. Such a frame of reference may notably define a certain number of tests to which the weapons will be subjected, and their permissible levels of reaction in an accident scenario. These tests are representative of the attacks that the weapons may experience during the course of their operational life.

The munitions associated with these reduced sensitivity weapons are referred to in French as "MURAT" (the acronym for "munitions à risque attènuè" which means "reduced-risk munitions") or in English as "insensitive munitions" (or "IM" for short). In particular, insensitive munitions need to meet certain specifications associated with thermal attack in the following two scenarios:

attack of the slow heating type (STANAG 4382);

attack of the rapid heating type (STANAG 4240).

Those skilled in the art in the field of the invention will understand that STANAG is the abbreviation of the term "Standardization Agreement" which in French is known as "Accords de normalisation" and groups together documents which define the procedures, the terms and the conditions adopted by the NATO member nations regarding military systems and equipment.

Insensitive munitions are munitions which, when subjected to thermal attack, must not react violently and must therefore react in a controlled manner.

Particularly sought after are munitions for which the level of reaction in the event of thermal attack is between V and VI on the following six-level scale (ranging from the least-violent reaction VI to the most violent I):

VI: no sustained reaction of the munition,

V: munition burns,

IV: pneumatic explosion of the munition

III: deflagration of the munition,

II: partial detonation of the munition

I: total detonation of the munition

The technical problem is therefore to provide munitions that offer a type-V (munition burns) or type-VI (no sustained reaction) response to a thermal attack of the slow or rapid heating type.

A munition, as depicted in FIG. 1, generally comprises a propulsion element (not depicted in the figures) connected to a projectile element 1. The projectile element 1 is an element that is elongate in the longitudinal direction X. The projectile element 1, also referred to for simplicity as the "projectile", comprises a first part 2 containing the explosive charge 21 and a second part 3 comprising an actuating element that triggers/initiates the explosive charge, typically comprising an initiation chain. The explosive charge is contained in a body 22, also referred to as the "munition body". The body may have a thickness of between a few millimeters to a few centimeters. As depicted, the body may further be in at least two parts 221, 222. It may also have an open end **22*a* situated facing the second part, its opposite end 22*b* being closed. For the sake of brevity, the first part may be referred to as "warhead body". The second part may be referred to as the "fuze". Between the first and second parts, or integrated into the second part, there may be an initiating relay completing the initiation chain. When the first and second part are assembled, they form the projectile 1 which is closed; in this case, the open end 22*a* of the munition body 22 is closed off, thus confining the explosive charge 21**.

Devices for reducing the sensitivity of munitions do exist. Their principle is generally to vent the explosive charge. They exploit one or more of the various phenomena which may occur when the heat is transmitted to a munition. Specifically, when a munition does not have a sensitivity-reduction system and is subjected to thermal attack, its explosive charge will increase in temperature and may reach the cookoff temperature of said explosive charge, causing the latter first of all to burn. Thereafter, under the effect of the confinement of the explosive charge in the body, the munition is liable to transition to a pneumatic explosion, or even a deflagration or a detonation. This is why it is necessary quickly to open the body of the explosive charge once the munition has been subjected to the attack, so that the explosive is vented and can, in the worst case, burn in the open air.

In order to achieve this venting, use is generally made of the reaction, under the effect of the temperature, of the energetic charge in order to create an overpressure in the body in which it is located and cause an opening to appear in said body, or even cause controlled bursting of the body, thus allowing venting. The opening of the body may be achieved by disconnecting the first and second parts.

As indicated above, there are a number of phenomena that can be exploited in order to vent the explosive charge. The phenomena exploited may notably be dependent on the nature of the explosive.

In a first case, the first phenomena exploited is the cooking off of the explosive, and therefore the burning thereof, generating a combustion gas and, therefore, an overpressure in the projectile. This overpressure needs to allow an opening or even a controlled bursting of the body. In this case, it is necessary to create a weakened zone in the projectile which is able to break open quickly before the reaction of the explosive runs away, as this would rapidly lead to a violent reaction.

This first phenomenon is notably exploited in patent application FR2995075 in which a munition initiating fuze comprises a ring that can be sheared under the effect of a gas pressure, allowing the munition to vent.

In a second case, the second phenomenon exploited is the change in phase (the melting) of all or part of the explosive charge, leading to a change in density and, therefore, to a hydraulic overpressure in the body and therefore in the projectile. This overpressure needs to allow an opening or even controlled bursting of the body. Just as with the first case, it is necessary to provide a weakened zone in the projectile. The opening in the projectile needs to occur rapidly, at least sufficiently before a pyrotechnic phenomenon (combustion, deflagration, detonation) occurs.

This second phenomenon is notably exploited in patent application FR2922638 which describes a munition which comprises an energetic charge confined in a casing, the energetic charge being able to expand upon a change in phase at a temperature below its cookoff temperature, and the casing comprising at least two parts connected by a mechanical connection designed to break under the effect of the internal pressure in the casing brought about by a change in phase of the charge.

In all these instances, use is made of a device known as a venting device, which uses a physically weakened zone of the projectile, which is either a zone of the body or an interface component (for example between the first and second parts or between two parts of the body) and which acts like a mechanical fuse, so as to exercise precise control over the opening of the body and vent the explosive charge.

However, the existing devices have the following disadvantages.

In the first instance, a pyrotechnic event is necessary for the opening of the body. Thus, the risk of runaway and of transition from a burn to an explosion and/or a deflagration and/or a detonation is high if the opening of the body is not sufficiently rapid and/or if it does not reach a sufficient size to sufficiently vent the explosive charge.

In the second instance (respectively in the first instance), the device operates only if the body remains liquidtight (or respectively gastight). Now, once the body starts to open, or in the event of defective sealing, the melt liquid (or, respectively, the combustion gas) escapes, canceling any pressure force and thereby limiting the ability of the venting device to open.

Furthermore, in the second instance, the temperature may continue to rise, or even reach the cookoff temperature of the explosive charge. Thus, if the opening obtained in the body is insufficient, the situation reverts to that of the first instance, with the risk of runaway and of transition from a burn to an explosion, a deflagration and/or a detonation.

In both instances, the actuating element that triggers the explosive charge is liable to maintain its proximity to said explosive charge. As the temperature of this actuating element increases, to the point at which the pyrotechnic elements that it contains react, the effects induced may cause uncontrolled initiation of the explosive charge as a result of the proximity of the two parts.

SUMMARY OF THE INVENTION

The invention seeks to overcome the aforementioned disadvantages of the prior art.

More particularly, it seeks to provide a venting device for venting the explosive charge for a munition projectile that makes it possible to guarantee better reduction in the sensitivity of the munition, and notably makes it possible to ensure that the munition exhibits a type-V (munition burns) or type-VI (no sustained reaction) response to a thermal attack of the slow or rapid heating type.

The invention seeks to afford a venting device which makes it possible to avoid maintaining proximity between the actuating element and the explosive charge.

Furthermore, what is sought is a venting device that is simple to manufacture and to use, and inexpensive.

A first subject of the invention that makes it possible to achieve this objective is a venting device for venting an explosive charge for a projectile comprising a first part comprising a body containing an explosive charge and a second part comprising an actuating element for triggering said explosive charge, the first and second parts forming an assembly able to confine the explosive charge when they are connected, said venting device comprising:

a sealing means configured to render the projectile gastight and fluidtight when the first and second parts are connected;

an opening means able to allow the projectile to open, said opening means being able to be triggered when the internal pressure in the projectile is higher than or equal to a given pressure threshold;

a pushing means able to enlarge the opening of the projectile once the opening means has been triggered.

According to the invention, what is meant by "explosive charge" is the "main explosive charge".

The first subject of the invention is a venting device for a projectile that uses the pressure generated by a change in phase of the explosive charge (liquid or gas) to trigger an opening in the projectile, for example, but not exclusively, an opening between the explosive charge and the fuze.

The venting device of the invention comprises an opening means or a system of the mechanical fuse type able to open under the effect of the pressure, and a sealing means, typically a seal, configured in such a way as to ensure that the pressure in the projectile and/or in the body can reach a threshold pressure at which the fuse-type system is triggered.

Furthermore, the venting device according to the invention uses a pushing means, such as a spring, to ensure that the opening in the projectile is rapid and sufficient in size to guarantee venting. The pushing means operates in combination with the opening means so that it is triggered only when the opening means is itself triggered, and therefore when the opening has been initiated.

Thus, the venting device according to the invention makes it possible notably:

- to increase the rate of venting, or, in other words, to maximize the rate at which the explosive escapes, and thus to prevent, in a timely manner, the runaway of the reaction of the explosive charge,
- to ensure sufficient separation between the fuze, at least the initiation chain, and at least the most-part of the explosive charge, and notably to prevent inadvertent triggering of the latter following undesired initiation of the initiation chain.

That makes it possible, in all instances, to guarantee a type-V (munition burns) or type-VI (no sustained reaction) response to a thermal attack of the slow or rapid heating type.

The invention thus makes it possible to improve the known venting systems.

According to one embodiment, the venting device is configured in such a way as to allow an opening between the first part (comprising the explosive charge) and the second part (the detonation fuze) of the projectile.

That makes it possible to guarantee complete disconnection between the explosive charge and the fuze of the projectile and to guarantee efficient venting of the explosive charge.

According to one particular embodiment, the opening means is located between the first part and the second part of the projectile.

According to another embodiment, the body comprises a first part and a second part, and the venting device is configured in such a way as to allow an opening between said first part and said second part of the body.

That then makes it possible to guarantee that the explosive charge is sufficiently vented and that it is sufficiently distanced from the fuze of the projectile or, at least, that the most-part of said explosive charge is no longer in the immediate vicinity of the fuze.

According to one particular embodiment, the opening means is located between the first part and the second part of the body.

When mention is made of the idea of separation between the fuze and the explosive charge or the most-part of said charge, it should be understood according to the invention that what is sought is a minimum distance of separation between the fuze and the explosive charge when the venting device is triggered. This minimum separation distance is notably dependent on the sensitivity of the explosive charge and can be determined by the person skilled in the art operating in the field of the invention.

Furthermore, when mention is made of the idea of the "most-part" of the explosive, it should be borne in mind that the objective of the invention is to guarantee better reduction in the sensitivity of the munition, and notably to ensure that the munition, in the worst case, exhibits a type-V (munition burns) response to a thermal attack of the slow or rapid heating type. When the projectile is vented, it may be that a small quantity of explosive charge is still in the vicinity of the fuze, the essential thing being that the most-part of said charge is moved away therefrom when the venting device is triggered. This most-part is the amount necessary in order not to lead to undesired phenomena such as pneumatic explosion, deflagration, or even detonation of the munition, and it can be determined by the person skilled in the art operating in the field of the invention. Thus, the venting device and, in broader terms the projectile, will be dimensioned to make it possible to ensure that at least the most-part of the explosive charge is no longer in the immediate vicinity of the fuze.

In the first instance, in which the first phenomenon exploited is the cooking-off of the explosive and therefore the burning thereof, generating a combustion gas and, therefore, an overpressure in the projectile, and when the opening means is located at the level of the body, steps are taken to ensure that the opening triggered by the overpressure and amplified by the pushing means allows sufficient separation between the initiation chain and at least the most-part of the explosive charge. Particularly when the explosive charge is in divided solid form, it may escape through the opening formed in the projectile.

In the second instance, in which the second phenomenon exploited is the change of phase (the melting) of all or part of the explosive charge, the molten liquid explosive may escape through the opening formed in the projectile. This then ensures that the most-part of the explosive is moved away from the rest of the projectile and therefore notably from the fuze.

According to one embodiment, the opening means comprises a mechanical component able to break when the internal pressure is higher than or equal to the given pressure threshold, for example a threaded component the screw thread of which is able to strip when the internal pressure is higher than or equal to the given pressure threshold.

According to one embodiment, the pushing means comprises a compressed spring able to relax once the opening means has been triggered.

According to another embodiment, the pushing means comprises a blade able to release a pushing force once the opening means has been triggered.

According to another embodiment, the pushing means comprises a shape memory material capable of expanding under the effect of temperature.

According to one embodiment, the sealing means comprises at least one seal.

According to one embodiment, the venting device further comprises a first component connected to the first part of the projectile and located between said first and the second part of the projectile, the sealing means and the pushing means being located between said first component and said second part of the projectile. Said first component may act as a bearing surface for the pushing means, and may also serve to protect the explosive charge when a pushing force is applied.

According to one embodiment, the venting device further comprises a second component, connected to the second part of the projectile and located between the first part and the second part of the projectile, the sealing means and the pushing means being located between said second component and said first part of the projectile, or between said second component and said first component.

According to one particular embodiment, the sealing means is located on the first component or on the second component.

According to one particular embodiment, the pushing means is connected to the first component or to the second component.

According to one particular embodiment, the opening means is connected to the first component or to the second component.

A second subject of the invention is a munition comprising a projectile equipped with a venting device according to the first subject of the invention.

BRIEF DESCRIPTION OF THE DRAWINGS

Further features and advantages of the invention will become apparent from the following description given by way of nonlimiting illustration and made with reference to the attached figures among which.

DETAILED DESCRIPTION

Figure 1:
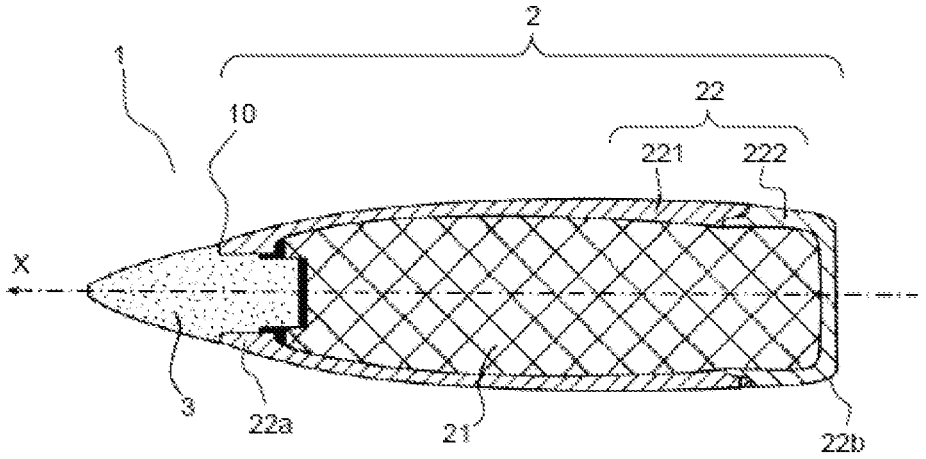
FIG. 1 depicts the projectile part of a munition according to the prior art.

FIG. 1 was described in the "Prior art" section of the present description and will not be revisited here.

Figure 2:
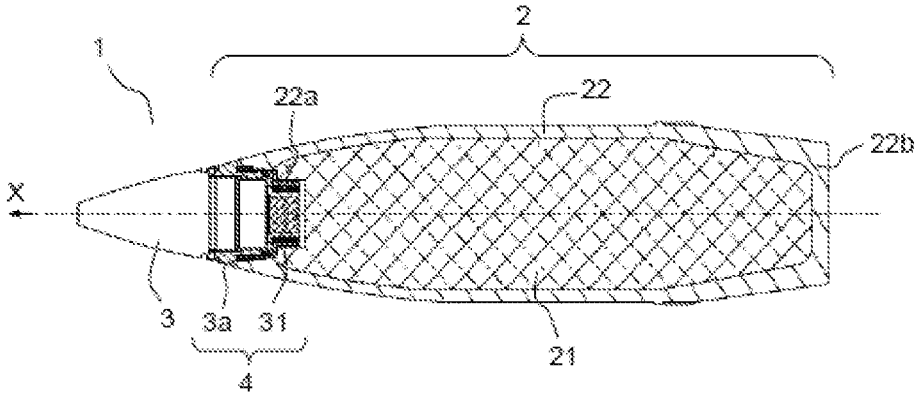
FIG. 2 depicts a first example of a device according to the invention, seen in the closed configuration.
Figure 3:
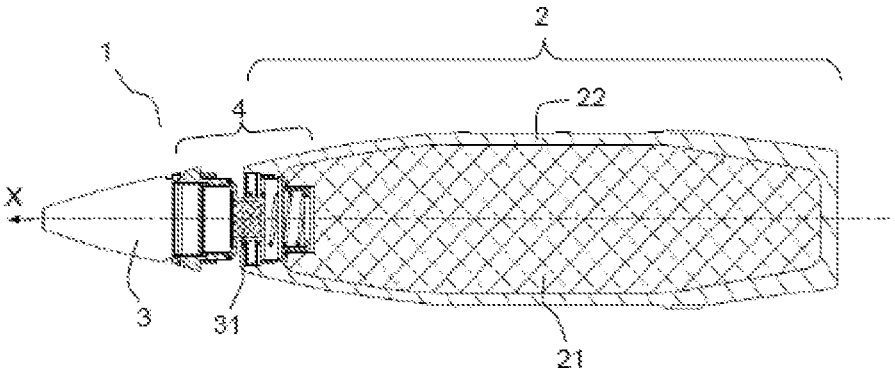
FIG. 3 depicts the first example of a device according to the invention, seen in the open configuration.
Figure 4:
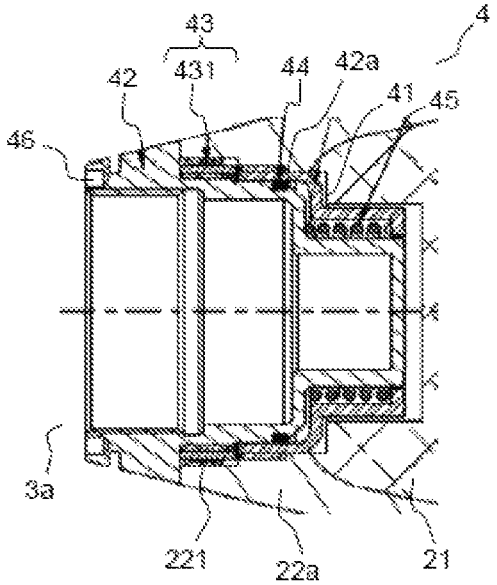
FIG. 4 depicts a detail of the first example of a device according to the invention.

FIGS. 2, 3 and 4 depict a first example of a venting device 4 according to the invention, seen in the closed configuration (device not triggered) and in the open configuration (device triggered). They readopt the same numerical references as FIG. 1 for elements that are in common with FIG. 1.

FIGS. 2, 3 and 4 illustrate a projectile element 1 for a munition. The propulsive element of the munition has not been depicted in the figures. The projectile element 1 is an element that is elongate in the longitudinal direction X and exhibits symmetry with respect to said longitudinal direction.

The projectile element 1 comprises a first part 2 containing the explosive charge 21 and a second part 3 comprising an actuating element for triggering the explosive charge. In FIG. 2, the first and second parts are depicted as solidly joined together (in the so-called "closed" configuration). In FIG. 3, the first and second parts are depicted as disconnected (the so-called "open" configuration).

The first part 2 comprises a munition body 22, also referred to as "body", delimiting an internal cavity containing the explosive charge 21. According to this first exemplary embodiment, the body 22 is made as a single part. The body may have a thickness of between a few millimeters to a few centimeters. As illustrated, the body 22 has an open end 22*a* situated facing the second part 3, its opposite end 22*b* being closed.

In the example illustrated, the second part comprises an initiating relay 31 located between the second part and the first part.

The first part may be referred to for the sake of simplicity as the "warhead body".

The second part may be referred to as the "detonation fuze" or, for the sake of simplicity, as the "fuze".

The fuze is depicted schematically here. Thus, conventionally, the fuze may comprise, in addition to an initiation chain, electronic or mechanical means that ensure its operation, a safety device, and means for initiating the initiation chain.

When the first and second parts are assembled, they form the projectile 1 which is a closed assembly. In other words, the fuze closes the munition body 22, closing off its open end 22*a*, thus confining the explosive charge 21.

According to the first exemplary embodiment shown, the venting system 4 is located between the fuze 3 and the warhead body 2. Said venting system makes it possible to form a connection between said fuze and said warhead body (when the system has not been triggered), or to break said connection (when the system is triggered). When the connection is broken, that is to say when the venting system is triggered, the fuze and the warhead body are disconnected.

The venting system depicted comprises several elements:

a first component 41, which can be referred to as the "first confinement cup" or "first cup" in the present invention: said first component may serve as a bearing surface for the pushing means 45 and may also serve to protect the explosive charge 21 from mechanical impacts; in the example illustrated, the first confinement cup 41 is configured to cover the end 2*a* of the warhead body that faces the fuze 3; it is connected to the body 22, for example by screwing.

a second component 42, which may be referred to as the "second confinement cup" or "second cup" in the present invention: said second component is configured in such a way as to cover all or part of the end 3*a* of the fuze that faces the warhead body 2, and is thus able to contain the initiation relay 31; it is connected to the fuze 3, for example by a screw-fastening system 46;

an opening means 43, which may be referred to as the "venting ring" in the present invention, able to allow an opening between the fuze and the warhead body, more specifically in the example illustrated between the second confinement cup 42 and the warhead body 2; the venting ring depicted is a threaded ring positioned on the second cup 42, the screw thread 431 of which being formed on its external surface. Said screw thread is intended to collaborate with a tapped thread 221 formed on an internal surface of the open end 22*a* of the munition body 22. The connection between the screw thread 431 and the tapped thread 221 makes it possible to form a connection between the fuze 3 and the warhead body 2. The screw thread 431 is configured to break when the internal pressure reaches a defined pressure threshold. More specifically, the screw thread strips under the effect of the thrust formed by the pressure. This then has the effect of breaking the connection between the fuze and the warhead body;

a sealing means 44, formed in the example illustrated by a circular seal system located in a groove 42*a* situated on an external circumference of the second confinement cup 42 facing the first confinement cup 41 (or alternatively, facing the body 22 for example if there is no first cup): the sealing means makes it possible to ensure that the pressure increases, preferably rapidly, in the projectile under the effect of the change in phase of the explosive charge (liquid or gas) until the threshold pressure able to trigger the venting ring 43 is reached;

a rapid pushing means 45, which is represented by a compressed spring located between the fuze 3 and the warhead body 2 and, more specifically in the example illustrated, between the first cup 41 and the second cup 42 (alternatively, the spring may be located between the second cup 42 and the body 22): when the venting ring 43 is triggered, the connection between the fuze 3 and the warhead body 2 is broken and the pushing means 45 allows these to be completely disconnected notably by overcoming the friction force of the stripped screw thread 431, of the seal system 44 and by exerting a force on the mass of the part that is to be pushed. This allows the connection between the fuze and the explosive charge to be opened up completely and makes it possible to ensure sufficient separation between said fuze and said explosive charge. This notably makes it possible to ensure the venting of the explosive.

Alternatively, the bearing surface of the pushing means 45 may be formed directly by an internal surface of the open end 22*a* of the munition body 22, without the need to fit a first cup.

In the example depicted, the venting ring is positioned on the second cup. Alternatively, it may be positioned on the first cup. As a further alternative, the venting ring may be positioned directly at the end 3*a* of the fuze that faces the warhead body 2, without there being a need to fit a first cup and/or a second cup.

The person skilled in the art will know how to calculate the characteristics of the spring in order notably to overcome the friction force of the stripped screw thread, of the seal system, and in order to exert a force on the mass of the part that is to be pushed.

Furthermore, the person skilled in the art will know how to determine the minimum separation distance to be obtained between the fuze and the explosive charge when the venting device is triggered. This minimum separation distance is notably dependent on the sensitivity of the explosive charge.

Figure 7:
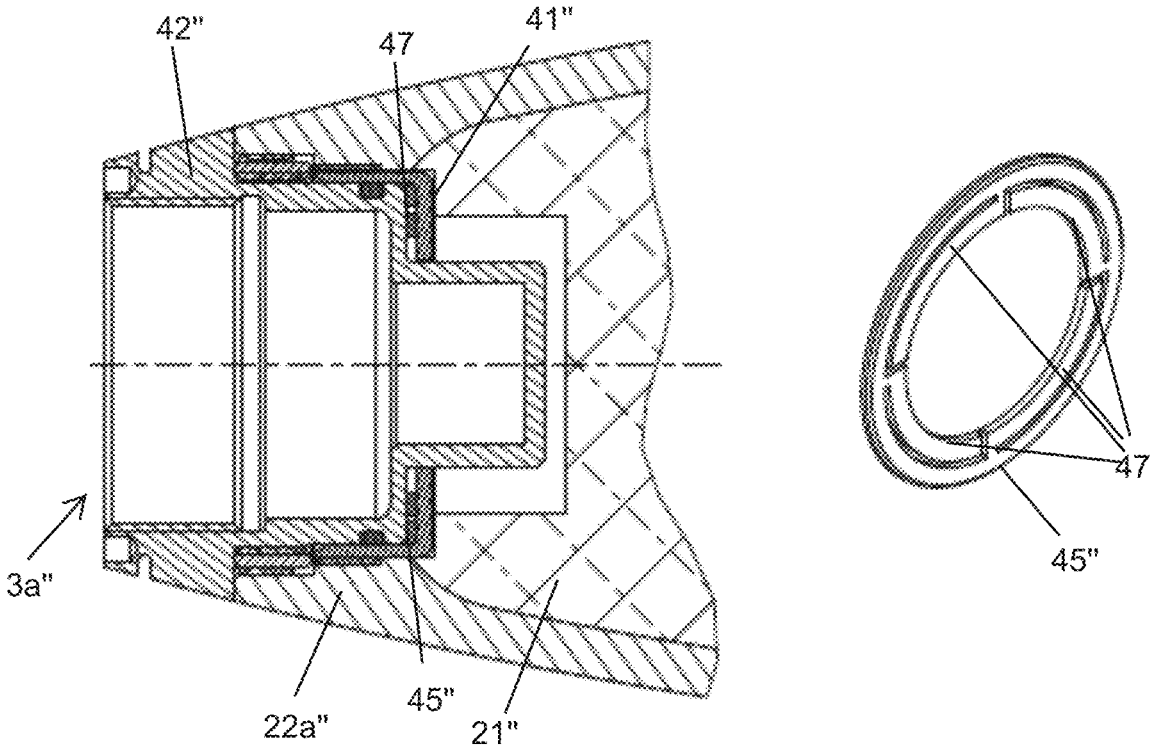
FIG. 7 depicts a third example of a device according to the invention, seen in the closed configuration.
Figure 8:
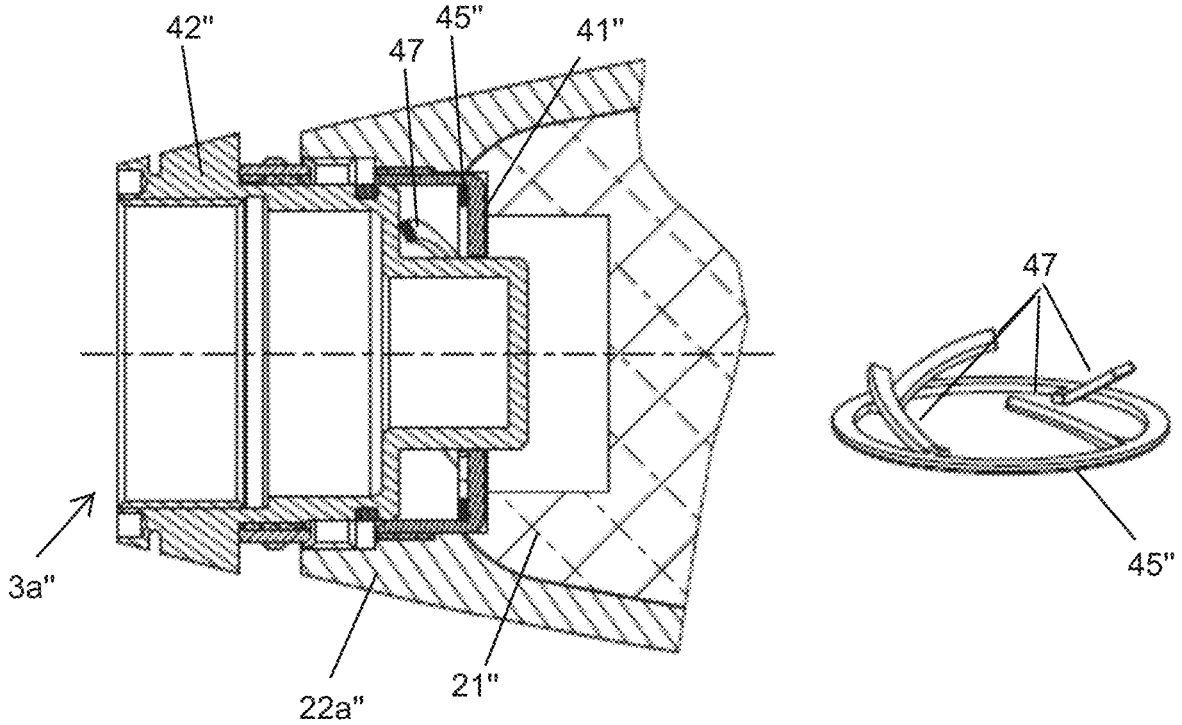
FIG. 8 depicts the third example of a device according to the invention, seen in the open configuration.
Figure 9:
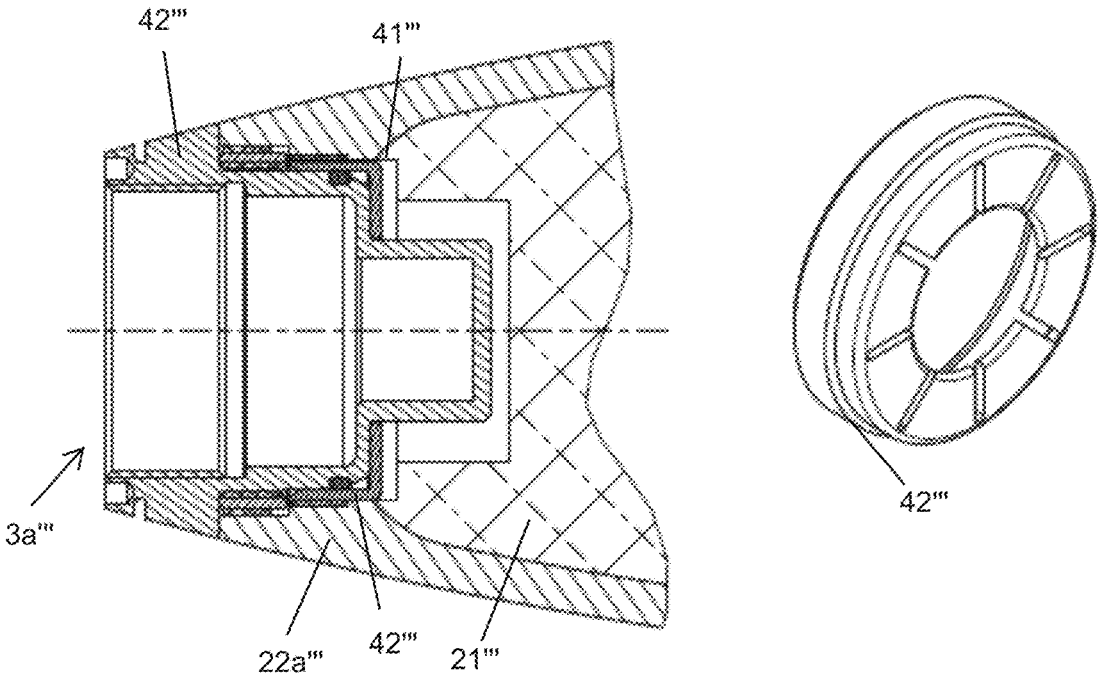
FIG. 9 depicts a fourth example of a device according to the invention, seen in the closed configuration.
Figure 10:
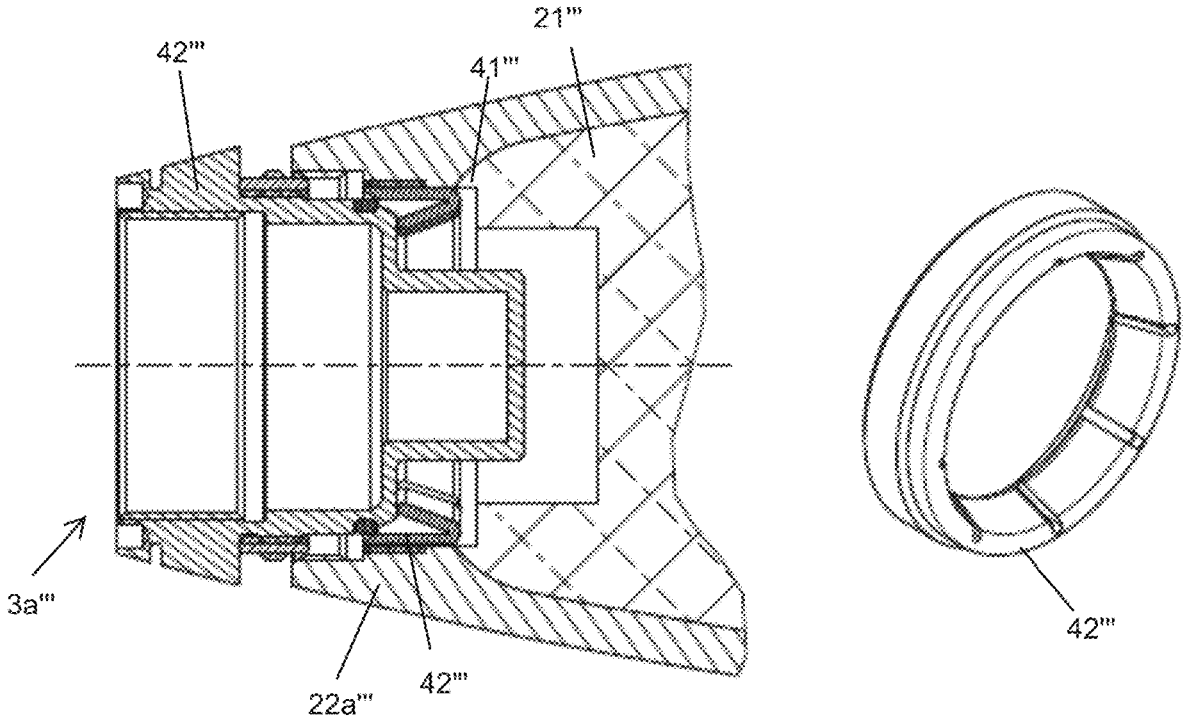
FIG. 10 depicts the fourth example of a device according to the invention, seen in the open configuration.

In place of a compression spring, the pushing means may be a blade 47 or a component made of shape memory material capable of expanding under the effect of temperature and, in general, any means able to create a rapid pushing force between two bodies (as illustrated in FIGS. 7-8). According to one alternative embodiment, of the first and the second cups 41, 42 one may have shape memory and thus fulfill the function of rapid pushing in place of a spring (as illustrated in FIGS. 9-10).

In place of a threaded venting ring, the opening means may be a component, such as a shear pin, able to be sheared at the defined pressure, or a bonded or welded joint engineered to withstand up to the defined pressure, or else a component a weakened part of which is engineered to withstand up to the defined pressure.

Figure 5:
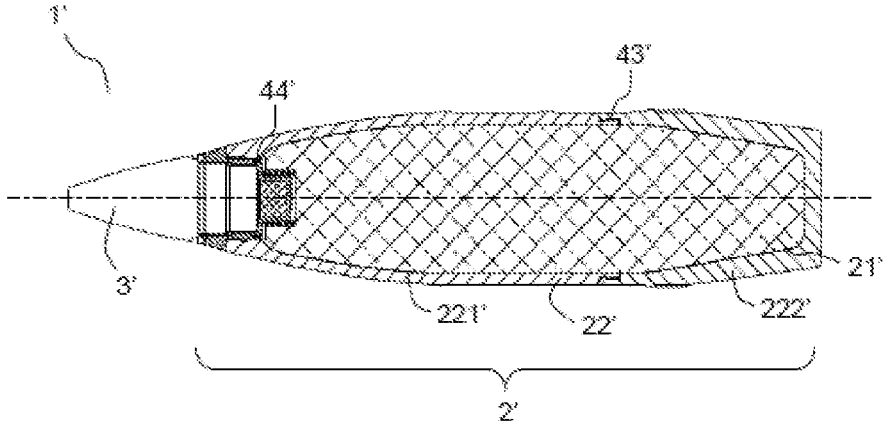
FIG. 5 depicts a second example of a device according to the invention, seen in the closed configuration.
Figure 6:
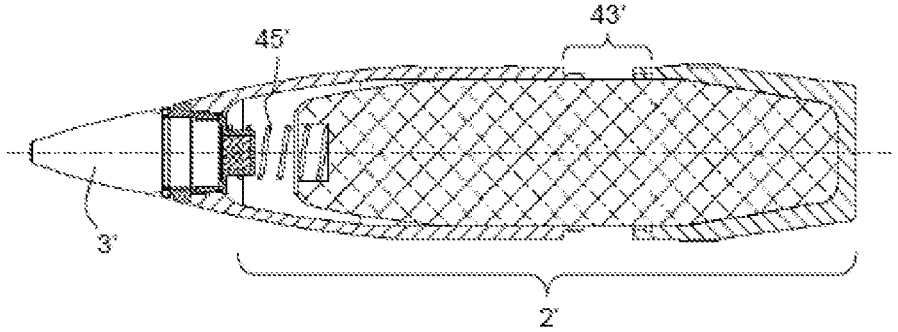
FIG. 6 depicts the second example of a device according to the invention, seen in the open configuration.

FIGS. 5 and 6 illustrate a second exemplary embodiment of a venting device 4' for a projectile 1'. FIG. 5 depicts a projectile 1' in the closed configuration (with the device not triggered). FIG. 6 depicts the projectile 1' in the open configuration (device triggered).

The second example differs from the first example in that the opening is generated on the body which separates into two parts and in that the opening means 43', or venting ring, is not located between the fuze and the warhead body, but is positioned at the level of the body 22', the body comprising a first part 221' located facing the fuze 3' and a second part 222' located in the opposite direction from said fuze. The other elements described in connection with FIGS. 2 to 4 are unchanged, as the alternative forms of embodiment may equally apply to the second example.

When the venting device has not been triggered (FIG. 5), the explosive is confined inside the body 22' closed by the fuze 3' at the level of its open end 22'*a*, and the first and second parts 221' and 222' of the body are assembled in a sealed manner.

When the venting device is triggered (FIG. 6), the body 22' is opened between the first and second parts 221' and 222' by virtue of the opening means 43' and the spring 45' located between the fuze 3' and the warhead body 2' acts almost instantly, pushing the second part 222' and carrying with it the explosive charge 21'. This makes it possible to ensure a sufficient separation distance between said explosive charge and the fuze 3'.

Thus, the opening in the projectile is created not between the fuze and the body but at the level of the body, which separates into two disconnected parts.

According to the second embodiment, the pushing means 45' is, as in the first embodiment, located between the fuze and the warhead body.

Alternatively, the pushing means may be located between the first or second parts of the body, or at any other point in the projectile suited to performing the same separating function.

According to the second embodiment, the sealing means 44' is located between the fuze and the warhead body.

Furthermore, another sealing means may be located between the first and second parts of the body (this is not depicted in the figures).

The following advantages become apparent from the embodiments described and from the invention in general.

The invention makes it possible to obtain rapid and significantly extensive venting, and this makes it possible in a timely manner to limit the overpressure phase of the explosive charge. Specifically, once the opening is formed when the opening means is triggered (or in other words, once the mechanical-fuse system has been triggered), the pushing system takes over and significantly enlarges the opening in the projectile independently of the state of the explosive charge. In other words, there is no longer a need for a pressure (gas pressure in the case of a burn, or hydraulic pressure in the event of the explosive melting) to be maintained.

The opening of the projectile is governed by the overpressure and not by the temperature, ensuring the integrity of the mechanical elements. Pressure control according to the invention also means that the maximum temperature attained by the projectile can be significantly below the cookoff temperature of the explosive charge.

Distancing the fuze and the explosive charge (or the most-part of the explosive charge) from one another allows the explosive charge to be distanced from the detonation system.

The venting device can be configured so that the fuze or the explosive charge is completely ejected from the projectile. Whether it is the fuze or the explosive charge that is able to be ejected, this notably makes it possible to avoid unwanted initiation of the explosive charge following undesired initiation of the initiation chain.

Furthermore, the opening of the projectile as permitted by the invention makes it possible to ensure a sufficiently high rate of escape of the gases notably associated with the cookoff phenomena in order to avoid runaway in the burning of the explosive and deflagration of said explosive.

In so doing, the invention guarantees a type-V or type-VI response to thermal attack.

The present invention is not restricted to the embodiment previously described but extends to any alternative form or to any embodiment that falls within the scope of the claims.

The invention claimed is:

1. A venting device for venting an explosive charge for a projectile comprising a first part comprising a body containing an explosive charge and a second part comprising an actuating element for triggering said explosive charge, the first and second parts of said projectile forming an assembly able to confine the explosive charge when said first and second parts of said projectile are connected, said venting device comprising:

- a sealing means configured to render the projectile gastight and fluidtight when the first and second parts of the projectile are connected;
- an opening means able to allow the projectile to open in order to create an opening in the projectile, said opening means being able to be triggered when an internal pressure of the projectile is higher than or equal to a given pressure threshold;
- a pushing means able to enlarge the opening of the projectile once the opening means has been triggered.

2. The venting device according to claim 1, configured in such a way as to allow an opening between the first part and the second part of the projectile.

3. The venting device according to claim 2, the opening means being located between the first part and the second part of the projectile.

4. The venting device according to claim 1, the body comprising a first part and a second part, and the venting device being configured in such a way as to allow the opening to form in the body between said first part of the body and said second part of the body.

5. The venting device according to claim 4, the opening means being located between the first part of the body and the second part of the body.

6. The venting device according to claim 1, the opening means comprising a mechanical component able to break when an internal pressure is higher than or equal to the given pressure threshold.

7. The venting device according to claim 6, wherein the opening means comprises a threaded component having a screw thread able to strip when the internal pressure of the projectile is higher than or equal to the given pressure threshold.

8. The venting device according to claim 1, the pushing means comprising a compressed spring able to relax once the opening means has been triggered.

9. The venting device according to claim 1, the sealing means comprising at least one seal.

10. The venting device according to claim 1, further comprising a first component connected to the first part of the projectile and located between said first part of the projectile and the second part of the projectile, the sealing means and the pushing means being located between said first component and said second part of the projectile.

11. The venting device according to claim 10, the sealing means being located on the first component or on the second component.

12. The venting device according to claim 10, the pushing means being connected to the first component or to the second component.

13. The venting device according to claim 10, the opening means being located between the first part of the projectile and the second part of the projectile, and the opening means being connected to the first component or to the second component.

14. The venting device according to claim 1, further comprising a second component, connected to the second part of the projectile and located between the first part of the projectile and said second part of the projectile, the sealing means and the pushing means being located between said second component and said first part of the projectile, or between said second component and said first component.

15. A munition comprising a projectile equipped with a venting device according to claim 1.

* * * * *